US007383782B2

(12) United States Patent
Wulf

(10) Patent No.: US 7,383,782 B2
(45) Date of Patent: Jun. 10, 2008

(54) WATERCRAFT

(75) Inventor: Udo Wulf, Klausdorf/Schwentine (DE)

(73) Assignee: New-Logistics GmbH, Goldenstedt (DE)

( * ) Notice: Subject to any disclaimer, the term of this patent is extended or adjusted under 35 U.S.C. 154(b) by 271 days.

(21) Appl. No.: 10/571,080

(22) PCT Filed: Aug. 30, 2004

(86) PCT No.: PCT/EP2004/009661

§ 371 (c)(1),
(2), (4) Date: Mar. 6, 2006

(87) PCT Pub. No.: WO2005/035353

PCT Pub. Date: Apr. 21, 2005

(65) Prior Publication Data

US 2007/0032146 A1 Feb. 8, 2007

(30) Foreign Application Priority Data

Sep. 17, 2003 (DE) ..... 103 43 078

(51) Int. Cl.
*B63B 1/06* (2006.01)
*B63H 5/07* (2006.01)
*B63H 5/125* (2006.01)
*B63H 5/16* (2006.01)

(52) U.S. Cl. ..... 114/56.1; 114/228; 114/57; 114/61.27; 440/68; 440/79

(58) Field of Classification Search ..... 114/271, 114/283, 288–292, 40–43, 56.1, 57, 60, 61.1, 114/61.26–63, 70, 150, 151; 440/66–70, 440/79; D12/300, 304, 309–314
See application file for complete search history.

(56) References Cited

U.S. PATENT DOCUMENTS

| | | | | |
|---|---|---|---|---|
| 251,529 | A * | 12/1881 | Davis | 114/57 |
| 298,019 | A * | 5/1884 | Oram | 440/70 |
| 299,128 | A * | 5/1884 | Gartner | 440/70 |
| 751,158 | A * | 2/1904 | Flindt | 114/57 |
| 759,536 | A * | 5/1904 | Manker | 440/79 |
| 2,812,738 | A | 11/1957 | Munro | |
| 3,557,736 | A * | 1/1971 | Baer | 114/151 |
| 3,611,972 | A * | 10/1971 | Duport | 114/151 |
| 3,688,721 | A * | 9/1972 | Bennett et al. | 114/321 |
| 3,710,748 | A * | 1/1973 | Baer et al. | 114/151 |

FOREIGN PATENT DOCUMENTS

| | | |
|---|---|---|
| DE | 34 43 137 A1 | 5/1986 |
| DE | 37 12 534 A1 | 11/1988 |
| DE | 38 38 791 A1 | 5/1990 |
| DE | 103 07 795 A1 | 9/2004 |

* cited by examiner

*Primary Examiner*—Ajay Vasudeva
(74) *Attorney, Agent, or Firm*—John A. Merecki; Hoffman Warnick LLC

(57) ABSTRACT

The invention relates to a watercraft, particularly a river boat, with a hull for receiving useful devices and with propulsion units for generating a driving force and which are located on the hull. The watercraft according to the invention is characterized in that guiding elements are provided in the bow area on the underside of the hull, which have a vertical, forwardly tapering wedge shape, that the propulsion units in the bow area are set back from the wedge-shaped guiding elements, that between the guiding elements is provided a partial area of the hull constructed in the form of a horizontal wedge and that the propulsion units are pivotably mounted.

16 Claims, 3 Drawing Sheets

WATERCRAFT

Figure 1:
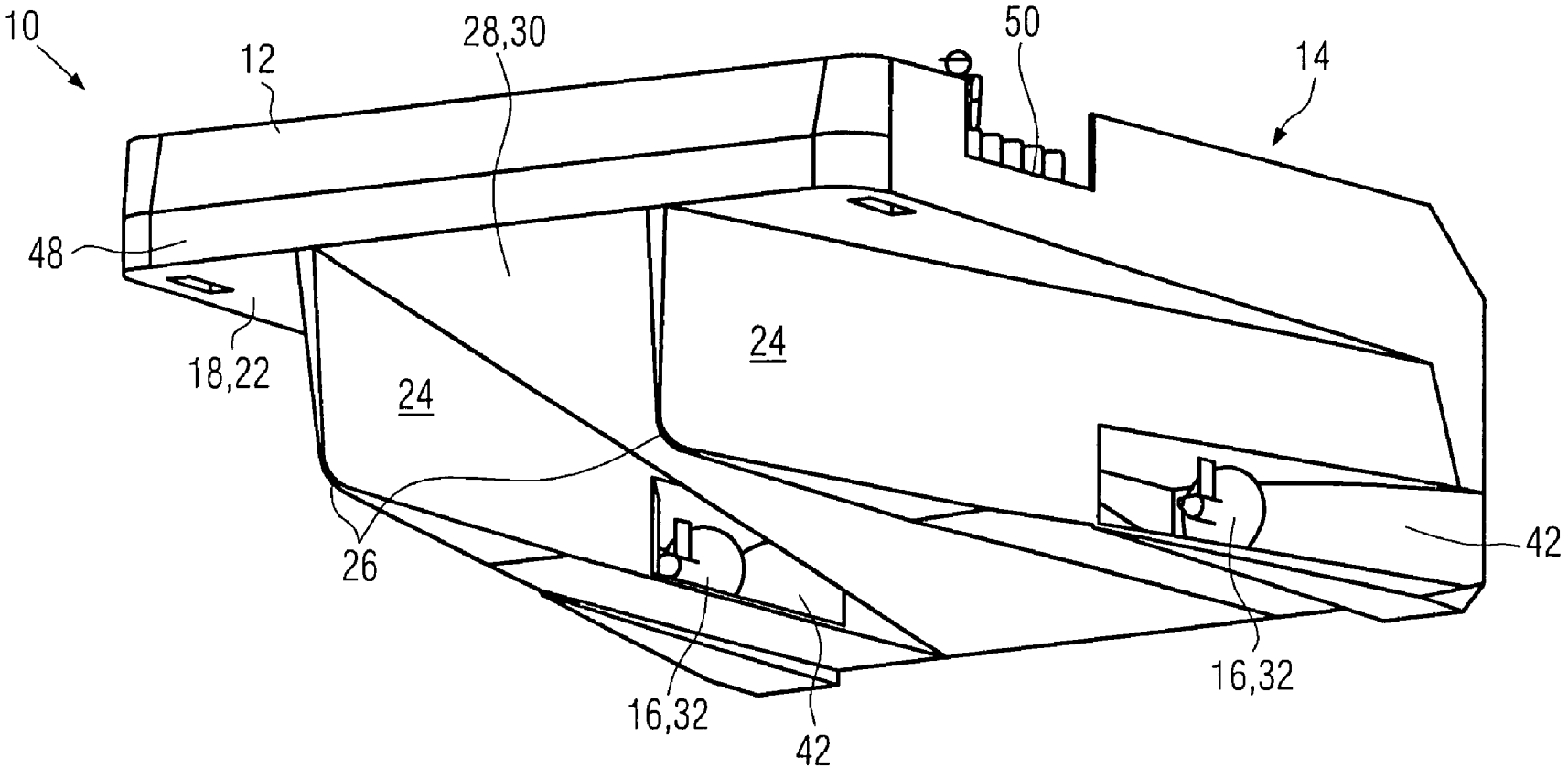

The present invention relates to a watercraft, particularly a river boat, according to the preamble of claim 1.

Such watercraft are e.g. known from DE 37 12 534 A1 and have a hull for receiving useful devices, together with propulsion units located on the hull for generating a driving force. In the bow area of the underside of the hull are also provided guiding elements, which in each case have a vertical, forwardly tapering wedge shape. Finally, between the guiding elements, is provided a partial area of the hull in the form of a horizontal wedge.

In the case of river craft the flow round the hull in shallow, laterally limited shipping channels becomes problematical with increasing speed and beam.

A conventional vessel bow mainly displaces the water laterally outwards and ever smaller, to almost no water is passed under the bottom of the vessel.

The vessel so-to-speak is sucked towards the bottom of the shipping channel and there is a rise in the lateral flow rate. The water then flows away ever less well and the boat starts to virtually push a water mountain in front of it. This mountain can only flow away between the side of the vessel and the bank, which once again leads to an ever higher lateral flow rate. Together with the ever smaller water quantity past under the bottom of the vessel in the stern direction, this inter alia considerably reduces the efficiency of the centrally rearwardly located drive propeller or propellers. In addition, a powerful transverse wave builds up behind the vessel and to a certain extent detains the vessel.

Relative to the availability of water for driving the vessel, in principle optimum propulsion conditions would exist on the bow side, but use cannot be made thereof with conventional vessel bow shapes. Instead of this an attempt is made in the stern by using complicated shapes and complex propulsion geometries, to gain an optimum from the in principle inferior afflux conditions. The action of transverse thrust units and horizontally positioned propeller/pump systems in the prow, such as are nowadays used in river boats, is naturally also significantly reduced through the high flow rates or the in extreme cases non-existent afflux of water under the boat.

Further watercraft with guiding elements are described in DE 29 28 634 B1 and DE 696 12 995 T2.

The object of the invention is to provide a watercraft of the aforementioned type, in which only part of the water is displaced to the side by the bow and in which the efficiency for the drive units is significantly improved.

This object is achieved by the watercraft having the features of claim 1.

According to the invention the watercraft of the aforementioned type is further developed in that the propulsion units in the bow area are set back with respect to the guiding elements and said propulsion units are pivotably mounted.

Advantageous developments of the inventive watercraft form the subject matter of subclaims.

A first essential idea of the invention is to provide in the bow area of the watercraft a plurality of guiding elements, which have a vertical wedge shape and taper in the forwards direction. As a result of said guiding elements a considerable proportion of the displaced water is displaced inwards and not outwards.

A further fundamental idea is to construct a partial area located between the wedge-shaped guiding elements in the form of a horizontal wedge, which also tapers upstream. As a result of a wedge-shaped partial area, the water displaced inwards by the guiding element can be passed under the hull.

A third fundamental idea is to place the propulsion units in the bow area so as to be set back with respect to the guiding elements. This clearly improves the efficiency of the propulsion units.

Finally, according to a fourth fundamental idea the propulsion units are pivotably mounted. Thus, it is e.g. possible to specifically adapt a setting angle of the propulsion units to the speed of travel. This leads to important advantages with regards to the efficiency of the drive units.

A first essential advantage of the invention is that, unlike the situation in the stern, water is supplied at the front with the dynamic pressure to the propulsion units. The dynamic pressure is then reduced over the propulsion units in the bow area, which gives the expectation, relative to the wave pattern in the bow area, of a similar effect to a bulb bow in conventional boat shapes.

A further advantage of the invention is that with this novel bow shape there is a significantly reduced wave formation, which greatly reduces damage to the banks compared with conventional river boats.

In a preferred development of the invention the guiding elements are provided starboard and port. A particularly large proportion of the displaced water can then pass under the watercraft.

A particularly good manoeuvrability of the watercraft is obtained if the propulsion units, which can appropriately be constructed as drive propellers, are mounted so as to pivot about a vertical axis. This also makes possible an angular adjustment of the drive propellers as a function of the speed of travel.

The partial area between the guiding elements can in this way be so constructed that it essentially has the bow shape of a sea sledge. The wedge-shaped guiding elements can be constructed in the manner of the prow geometry of a catamaran or semi-catamaran. These are known hull shapes, so that in this connection use can be made of known technologies and costs can be saved.

An improvement to the flow characteristics can be obtained if at least one of the guiding elements tapers rearwards in the vertical wedge shape. Particularly good results are obtained if in the case of at least one guiding element the stern-side wedge shape is made more blunt or obtuse than the bow-side wedge shape.

The efficiency of the propulsion units can be improved if the guiding elements have recesses in which the propulsion units are located. Particularly good results are obtained if the propulsion units are located in areas where a large number of flow lines converge, e.g. directly behind a stern-side edge of the guiding elements.

Obviously propulsion units can also be provided in the stern area of the hull. This brings about an even greater watercraft manoeuvrability.

The passing through of water under the hull can be improved if, particularly on the port and starboard sides, wedge-shaped guiding elements are also provided in the hull stern area. These guiding elements can also taper rearwards in the vertical wedge shape. Optionally such guiding elements can also be provided in the central area of the hull or also distributed over the entire hull length.

The passing of water quantities beneath the hull can also be improved by a device for smearing with air bubbles. These can in particular be devices of the type described in DE 103 07 795.

Preferably openings, e.g. water supply slots, are provided on the guiding elements in order to supply water to the propulsion units. These water supply slots are appropriately positioned lengthwise to the direction of travel and this also prevents flotsam or ice being forced into the drive units.

The geometry of the novel, innovative bow shape is eminently suitable for ice navigation and then the hull, particularly the bow-side guiding elements, are preferably constructed for ice breaking purposes.

The catamaran hulls cut the ice covering by pressure from above. Only roughly half the broken ice flows have to be laterally displaced and the other half is moved under the hull and is passed rearwards in low-friction manner via the e.g. air bubble-smeared bottom. A specific stern shape then prevents the rear propulsion units being damaged by ice flows. In order to protect the bow-side propulsion units during such ice navigation, there are provided appropriately covering devices for the at least partial covering of the recesses in the guiding elements in which the propulsion units are located.

During ice navigation with a limited draught, the front propulsion units are switched off and an outer tunnel slot on each outside is covered from the front up to the level of the propulsion units with the aid of a rail-guided covering device, which can be in the form of a bow door. Thus, when travelling in ice with the vessel empty or in ballast, no ice flows can enter the front propulsion tunnel.

Thus, an essential basic principle of the present invention is the angularity of the drive units in conjunction with the geometry of the bow shape. The propeller thrust results in a forward thrust and propeller wake friction on the side of the vessel can be largely avoided. The setting angle of the front, i.e. bow-side drive units can always be adapted in optimum manner to the vessel speed. Particularly good results can be obtained if the drive units are rotatable about a vertical axis and thus can consequently be set at random angles as a function of the speed of travel.

With the watercraft according to the invention is also created a bow shape, in which in planned manner a part of the inflowing water is deflected under the ship and to the drives instead of outwards to the side only part of the inflowing water is displaced laterally outwards.

Figure 3:
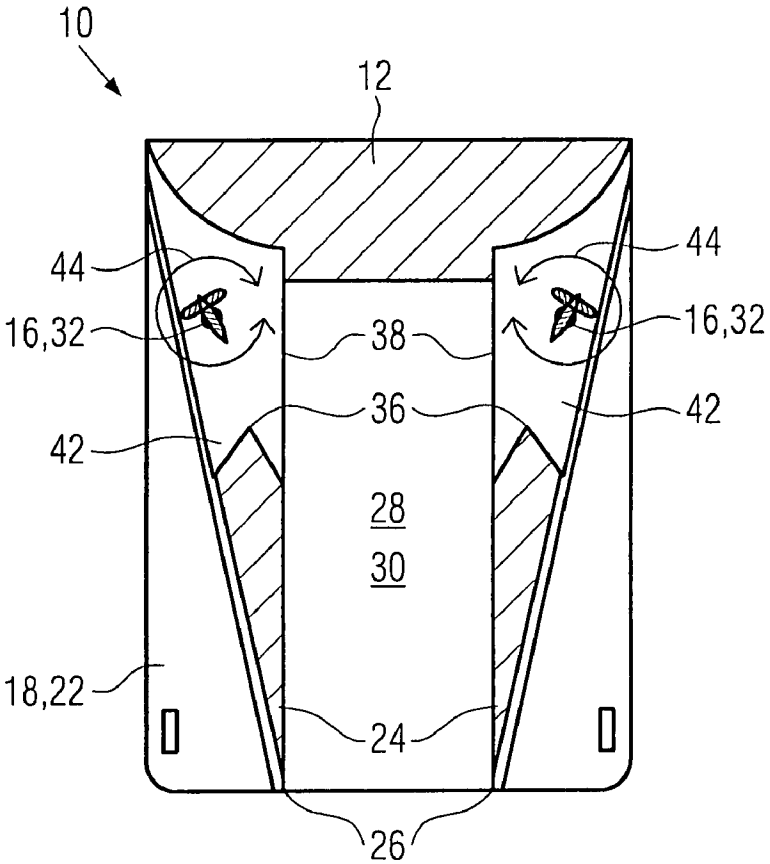
Figure 2:
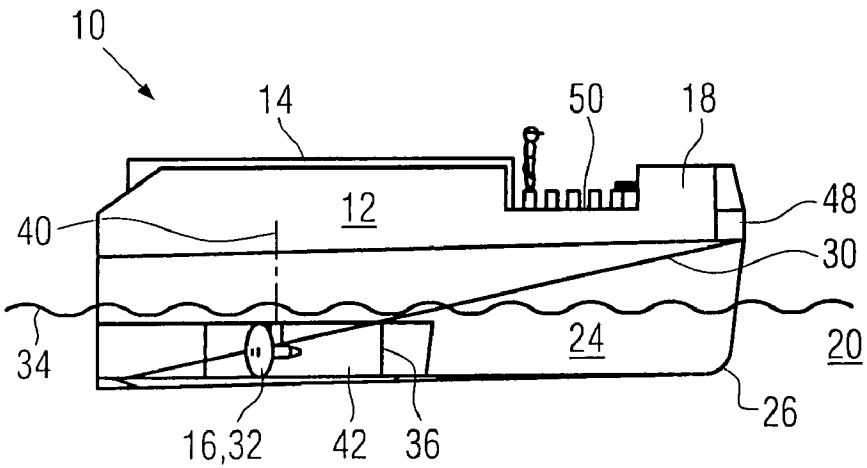

Further characteristics and advantages of the inventive watercraft are described in greater detail hereinafter relative to the attached drawings, wherein show:

FIG. 1 a perspective view of the bow shape of a watercraft according to the invention;

FIG. 2 a vertical sectional view in the direction of the longitudinal axis of the watercraft of FIG. 1;

FIG. 3 a horizontal sectional view of the watercraft of FIG. 1; and

Figure 4:
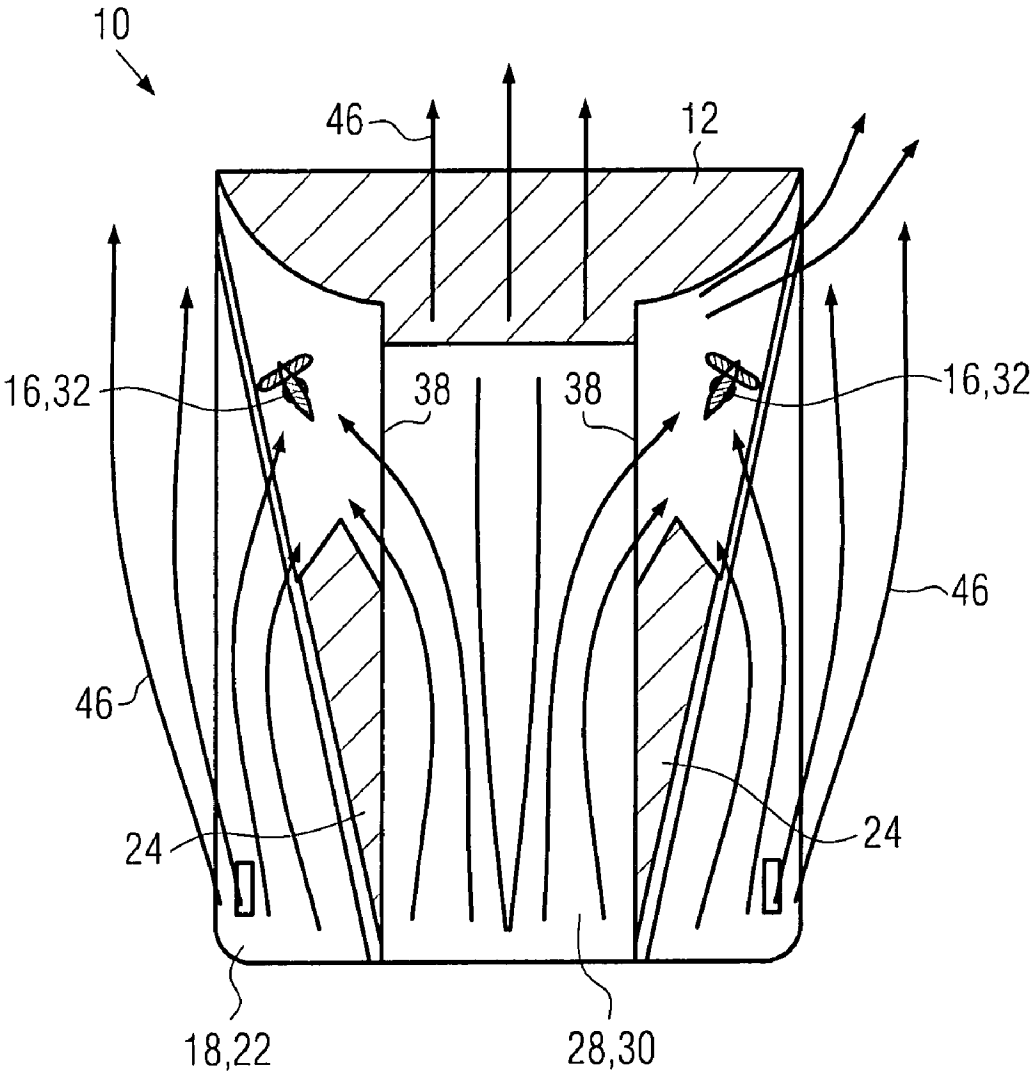

FIG. 4 another horizontal sectional view of the watercraft of FIG. 1.

FIGS. 1 to 4 show an embodiment of a watercraft 10 according to the invention in the form of a river boat 10. Equivalent components are in each case given the same reference numerals.

In each case it is shown a bow area 18 of the inventive river craft 10. Random useful devices 14 can be placed on a top surface 50 of hull 12. Wedge-shaped guiding elements 24 according to the invention are provided port and starboard on the underside 22 of the hull 12 facing the water 20. According to the invention the guiding elements 24 taper forwards to bow-side wedge shapes 26, which in the embodiment shown here terminate with a bow-side hull end 48 and are directed substantially transversely to the water surface 34. Thus, the shape of the guiding elements 24 can be looked upon as a vertical wedge shape.

As is apparent from the horizontal sectional view of FIG. 3, the inwardly positioned lateral faces of the wedge-shaped guiding elements 24 bound a cross-sectionally, substantially rectangular partial area 28. According to the invention said partial area and as can be particularly clearly seen in the perspective view of FIG. 1 and vertical sectional view of FIG. 2, can be constructed as a horizontal wedge 30, which tapers in the direction of the bow-side end 48 of hull 12, i.e. in the forwards direction.

FIG. 3 also shows openings 38 over which water can be supplied to the propulsion units 16, as is shown in greater detail in FIG. 4. These openings are positioned lengthwise to the travel direction, which largely prevents a forcing of flotsam or ice into the drive units 16, 32.

As a result of the cooperation between the laterally positioned, wedge-shaped guiding elements 24 and the partial area 28 constructed as a horizontal wedge, a considerable proportion of the water striking the hull on the bow-side is passed between the guiding elements 24 and consequently under the hull 12. The substantially parallel, inwardly positioned lateral faces of the wedge-shaped guiding elements 24 lead to a particularly smooth flow behaviour, because eddy formation can be largely prevented.

Recesses 42 are provided in both guiding elements 24 for the reception of drive propellers 32 as propulsion units 16. The drive propellers 32 are pivotably mounted about a vertical axis, i.e. about an azimuth angle. Preferably the drive propellers 32 can be rotated over at least 180°, but in principle larger rotation angles can be obtained. In this way and in particular if there are corresponding drive units on the stern side, excellent manoeuvrability of the river craft 10 according to the invention can be obtained.

The guiding elements 24 taper rearwards to the stern-side wedge shapes 36 which, compared with the bow-side wedge shapes, have a more obtuse construction 26 and also extend substantially transversely to the water surface 34, i.e. also constituting vertical wedge shapes.

The particularly advantageous flow pattern attainable with the inventive bow shape is illustrated diagrammatically in FIG. 4 with the aid of a plurality of arrows 46. In conjunction with the partial area 28 constructed as a horizontal wedge 30 and the lateral faces of the wedge-shaped guiding elements 24, as a result of the construction of the bow and stern-side wedge shapes 26, 36 of guiding elements 24 a flow pattern is obtained in which a particularly large number of flow lines converge behind the stern-side wedge shapes 26. Thus, the drive propellers 32 are located precisely where a particularly large number of flow lines converge. Apart from the particularly smooth flow behaviour and limited wave formation, in the invention this leads to a clear improvement to the efficiency of the propulsion units 32.

Thus, according to the invention, based on the bow shape of the sea sledge in conjunction with the front geometry of a semi-catamaran, the represented bow shape is implemented in conjunction with azimuthing, vertical propeller drives. Even in the case of very shallow water, with the novel bow geometry only part of the water in front of the vessel is displaced to the side from the bow and the remainder is guided by the bow under the vessel or supplied to the front drive propellers.

Thus, the bow essentially comprises three wedges, in each case one vertical wedge on the outside, similar to the prow geometry of a catamaran (or semi-catamaran) and in the centre between them a horizontal wedge, similar to the bow shape of a sea sledge.

The outer bow parts, i.e. the catamaran wedges, displace part of the water outwards in front of the vessel, whereas the horizontal wedge shape of the sea sledge guides the water between the catamaran hull parts under the vessel and to the propulsion units located outside in the catamaran hull parts, which are mainly constructed as vertical, azimuthing propellers.

The propulsion units are in each case so positioned in a type of tunnel in the lateral bow hulls, that they can be pivoted over at least 180°, i.e. can also exert a thrust to the side and forwards, e.g. for slowing down the vessel.

The invention claimed is:

1. Watercraft, having a hull for receiving useful devices, in which on an underside of hull in a bow area and both to port and starboard is in each case provided a guiding element, which in each case has a vertical, forwardly tapering wedge shape, in which between the two guiding elements is provided a partial area of hull constructed in the form of a horizontal wedge and with propulsion units located on the hull for generating a driving force, wherein in the bow area in each case at least one propulsion unit is set back from the guiding element, the propulsion units are pivotably mounted and the guiding elements have recesses in which are located the propulsion units.

2. Watercraft according to claim 1, wherein the propulsion units are pivotable about a vertical axis.

3. Watercraft according to claim 1, wherein the propulsion units are constructed as drive propellers.

4. Watercraft according to claim 1, wherein the partial area essentially has the bow shape of a sea sledge.

5. Watercraft according to claim 1, wherein at least one of the guiding elements tapers rearwards in the form of a vertical, stern-side wedge.

6. Watercraft according to claim 5, wherein the stern-side wedge shape of at least one guiding element is more obtuse than the bow-side wedge shape.

7. Watercraft according to claim 1, wherein additional propulsion units are provided in the stern area of the hull.

8. Watercraft according to claim 1, wherein in the stern area of the hull are provided guiding elements with a vertical wedge shape, which taper rearwards.

9. Watercraft according to claim 1, wherein covering devices are provided for the at least partial covering of recesses.

10. Watercraft according to claim 1, wherein the hull is constructed for ice breaking purposes.

11. Watercraft according to claim 1, wherein a setting angle of the propulsion units is adaptable to a speed of travel.

12. Watercraft according to claim 1, wherein on the guiding elements are provided water supply slots for the propulsion units, the water supply slots being provided lengthwise to the direction of travel.

13. Watercraft according to claim 1, wherein port and starboard, in the stern area of the hull are provided guiding elements with a vertical wedge shape, which taper rearwards.

14. Watercraft according to claim 1, wherein the bow-side guiding elements of the hull are constructed for ice breaking purposes.

15. Watercraft according to claim 1, including a device for smearing with air bubbles.

16. River boat, having a hull for receiving useful devices, in which on an underside of hull in the bow area and both to port and starboard is in each case provided a guiding element, which in each case has a vertical, forwardly tapering wedge shape, in which between the two guiding elements is provided a partial area of hull constructed in the form of a horizontal wedge and with propulsion units located on hull for generating a driving force, wherein in the bow area in each case at least one propulsion unit is set back from the guiding element, the propulsion units are pivotably mounted and the guiding elements have recesses in which are located the propulsion units.

* * * * *